United States Patent [19]

Ozu et al.

[11] Patent Number: 4,687,136

[45] Date of Patent: Aug. 18, 1987

[54] GAS INJECTION VALVE FOR GAS ENGINE

[75] Inventors: Tadahiro Ozu; Nobuyoshi Nakayama; Tatsuo Fujii, all of Kobe, Japan

[73] Assignee: Kawasaki Jukogyo Kabushiki Kaisha, Hyogo, Japan

[21] Appl. No.: 814,723

[22] Filed: Dec. 30, 1985

[30] Foreign Application Priority Data

Feb. 15, 1985 [JP] Japan ..... 60-29110

[51] Int. Cl.[4] ..... F02M 47/04

[52] U.S. Cl. ..... 239/8 X; 239/124; 239/533.8

[58] Field of Search ..... 239/408, 410, 411, 86, 239/533.1, 533.2, 533.5, 533.6, 533.7, 533.8, 533.9, 533.3, 584, 86–95, 583, 533.11, 533.12, 124

[56] References Cited

U.S. PATENT DOCUMENTS

| | | | |
|---|---|---|---|
| 3,640,466 | 2/1972 | Steiger | 239/533.8 |
| 3,738,576 | 6/1973 | O'Neill | 239/533.8 |
| 4,349,152 | 9/1982 | Akagi | 239/533.2 |
| 4,465,231 | 8/1984 | Sharp | 239/533.5 |

FOREIGN PATENT DOCUMENTS

| | | |
|---|---|---|
| 3044254 | 6/1982 | Fed. Rep. of Germany . |
| 2478205 | 9/1981 | France . |
| 2478206 | 9/1981 | France . |
| 58-124660 | 8/1983 | Japan . |
| 59-24959 | 2/1984 | Japan . |

OTHER PUBLICATIONS

15th International Congress on Combustion Engines. ISME Tokyo, 1983, Third International Symposium on Marine Engineering.

*Primary Examiner*—Andres Kashnikow
*Assistant Examiner*—Michael J. Forman
*Attorney, Agent, or Firm*—Wenderoth, Lind & Ponack

[57] ABSTRACT

A gas injection valve of a gas engine includes a valve body having a nozzle chamber with nozzle holes for injecting fuel gas, a first gas passage for introducing fuel gas, and a second gas passage communicable at one end to the first gas passage and at the other end to the nozzle chamber. A first needle valve closes and opens communication between the first and second gas passages. A second needle valve closes and opens communication between the second gas passage and the nozzle chamber. The first and second needle valves are urged in the closing direction thereof. A hydraulic actuator opens the two needle valves. An extreme tip of the first needle valve in closed state is disposed within and exposed to the interior of the second gas passage.

7 Claims, 5 Drawing Figures

GAS INJECTION VALVE FOR GAS ENGINE

BACKGROUND OF THE INVENTION

This invention relates generally to gas injection valves of gas-fired engines or gas engines and more particularly to a gas injection valve of high safety characteristic in which, even in the event of sticking of a needle valve thereof, the passage through which the fuel gas flows to the injection nozzle is positively shut in accordance with the cyclic operation of the engine.

In the prior art, gas injection valves of various constructions for gas engines have been proposed, and many have been reduced to practice. A specific example is the gas injection valve described and illustrated on page 1202 and FIG. 9, Conference Papers of 15th International Congress on Combustion Engines in Paris, 1983. In this gas injection valve, as will be described more fully hereinafter, a single needle valve is provided for closing and opening the flow path of the fuel gas through a gas passage to an injection nozzle. This needle valve is opened by hydraulic pressure and closed by the force of a compression spring.

In the case of defective operation such as jamming or sticking of the needle valve caused by foreign matter caught between the valve and its valve seat or by deformation or breakage of one or more related parts, the gas flow path from the gas passage to the injection nozzle cannot be closed by the needle valve and is kept opened even when it should be closed in the engine working cycle. Consequently, the injection fuel gas at a high pressure is continuously injected into the combustion chamber. This defective operational state could give rise to a dangerous result such as abnormal combustion or continuous flow of fuel gas in the uncombusted state into the engine exhaust pipe or air intake pipe and causing an explosion. This dangerous result could also be caused by damage or breakage of the above mentioned compression spring.

SUMMARY OF THE INVENTION

This invention seeks to solve the above described problem by providing a gas injection valve of high safety factor which is capable of positively closing the gas shut-off mechanism thereof even in the event of defective operation such as the above described sticking or jamming of the needle valve due to entrapment of foreign matter or deformation of the valve or a related part or failure of the valve to close because of breakage of a spring, and which thereby eliminates the above described dangerous state.

According to this invention, briefly summarized, there is provided a gas injection valve for injecting fuel gas into a combustion chamber of a gas engine, said injection valve comprising: an injection valve body having a nozzle chamber with nozzle holes for thus injecting fuel gas, means forming a first gas passage for introducing fuel gas into the body, and means forming a second gas passage having an upstream end communicable with the first gas passage and a downstream end communicable with the nozzle chamber; a first needle valve disposed between the first and second gas passages for closing and opening communication therebetween; a second needle valve disposed between the second gas passage and the nozzle chamber for closing and opening communication therebetween; actuating means for applying forces respectively for urging the first and second needle valves in the closing directions thereof; and a hydraulic actuating system for applying forces respectively urging said needle valves in the opening directions thereof, the extreme tip of the first needle valve in the closed state being disposed within and exposed to the interior of the second gas passage.

The nature, utility, and further features of this invention will be more clearly apparent from the following detailed description with respect to preferred embodiments of the invention when read in conjunction with the accompanying drawings, briefly described below.

DETAILED DESCRIPTION OF THE INVENTION

Figure 5:
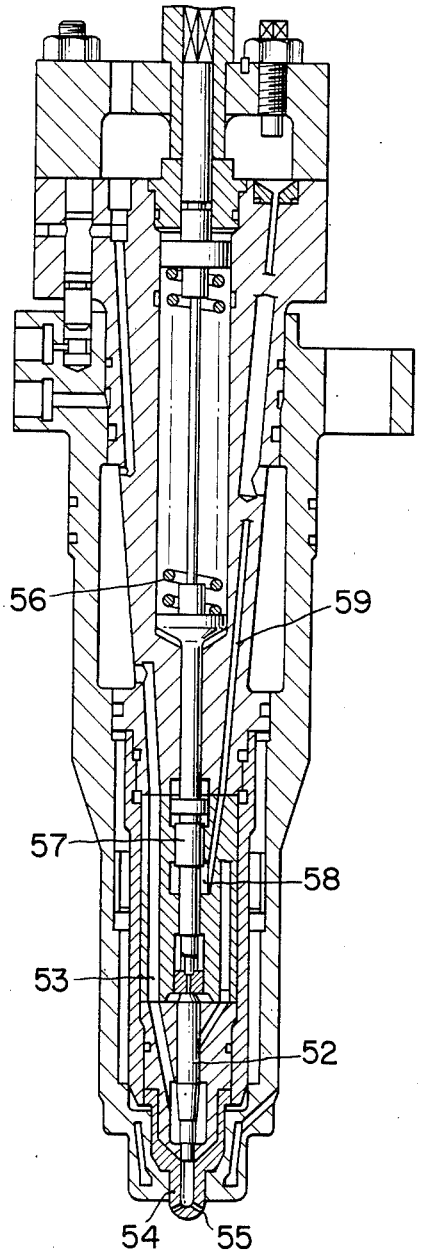
FIG. 5 PRIOR ART
FIG. 5 is a side view, in longitudinal section, showing an example of a known gas injection valve.

As conductive to a full understanding of this invention, the general nature, attendant problems, and limitations of a known gas injection valve briefly mentioned hereinabove will first be described with reference to FIG. 5.

In this example of a known gas injection valve, a needle valve 52 is slidably held within an injection valve body near the injection end thereof. By the sliding movement of this needle valve 52, communication between an injection gas supply passage 53 and nozzle holes 55 provided in a nozzle 54 at the extremity of the valve is established or shut off. In the instant example, the needle valve 52 is continually urged by a compressed coil spring 56 to move toward its valve seat or in the direction to close the passage 53 (downward as viewed in FIG. 5). The needle valve 52 is further provided at an intermediate part thereof with a piston part 57, which protrudes into a hydraulic pressure chamber 58 connected to a hydraulic flow path 59 formed through the valve body. When hydraulic pressure is applied through the flow path 59 to the pressure chamber 58, the piston part 57 is pushed upward, whereby the needle valve 52 is forced upward and away from its valve seat, overcoming the force of the coil spring 56, and the flow path of the injection gas through the gas passage 53 and past the needle valve is opened. The injection gas thereby is ejected through the nozzle holes 55.

However, in the case of defective action such as sticking of the needle valve 52 due to entrapment of foreign matter between the valve and its valve seat or to deformation of one or more related parts, the fuel gas flow path between the gas passage 53 and the nozzle holes 55 is kept in the open state, and it becomes impossible to close the gas passage 53 by means of the needle valve 52. As a consequence the injection gas (at a pressure of, for example, 200 to 300 kg/cm$^2$) is continuously discharged into the combustion chamber (at a maximum pressure of, for example, 100 to 140 kg/cm$^2$) of the engine cylinder. This state could give rise to a dangerous result such as abnormal combustion or the continuous flowing of injection gas in the uncombusted state into the exhaust pipe or air intake pipe and causing an explosion as mentioned hereinbefore. This dangerous state can arise as a consequence of a continuous flow of uncombusted injection gas in a manner similar to that as described above, due also to damage or breakage of the compression coil spring 56.

This invention provides a gas injection valve in which the above described difficulties have been overcome as will become apparent from the following detailed description thereof with respect to specific forms of the injection valve constituting preferred embodiments of the invention.

Figure 1:
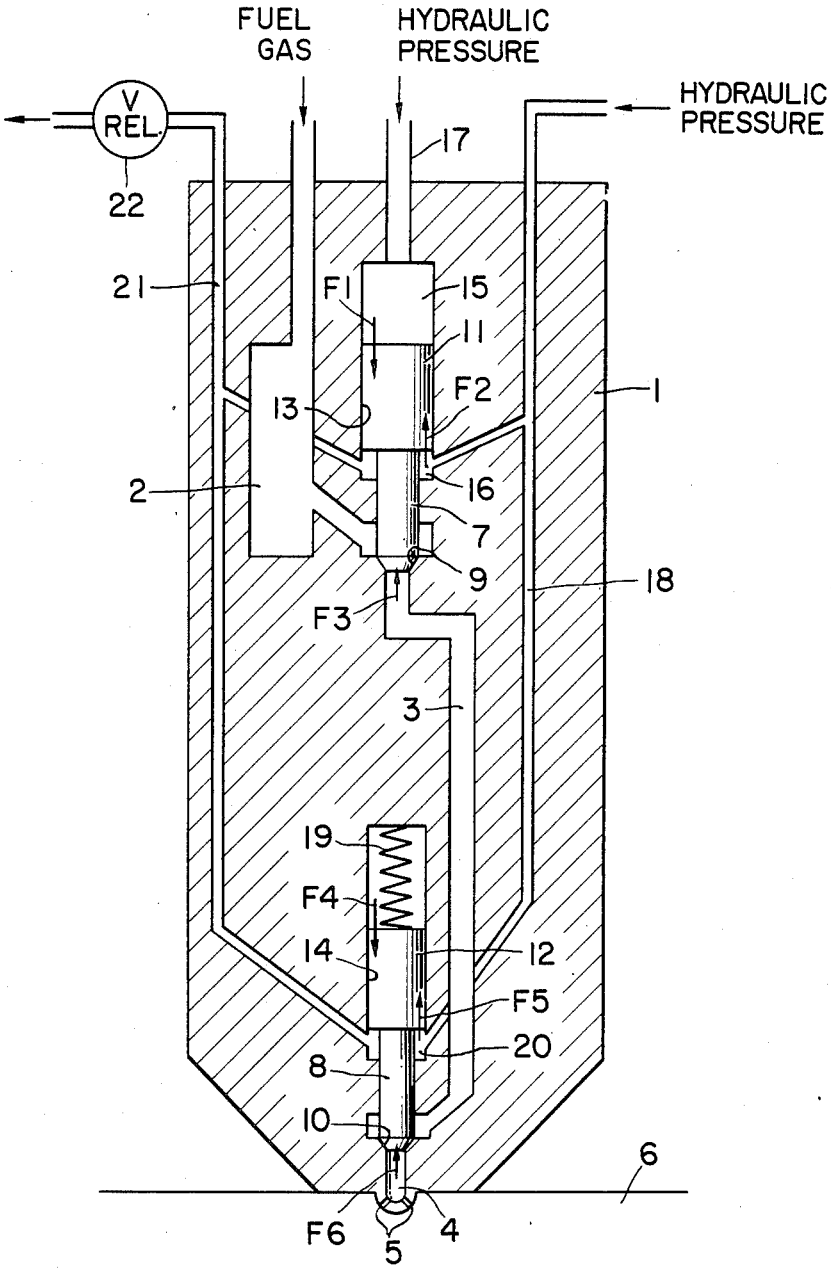
FIG. 1 is a schematic side view, in longitudinal section, showing the essential construction and arrangement of a first form of the gas injection valve according to this invention.

Referring first to FIG. 1, the gas injection valve of this invention shown schematically therein has an injection valve body 1 within which are provided: a first injection gas passage 2 for introducing injection gas; a second injection gas passage 3 communicating with the first gas passage 2 and at the same time communicating with a the combustion chamber 6 of a cylinder of a gas engine (not shown) via a nozzle chamber 4 and nozzle holes 5; a first needle valve 7 adapted to undergo sliding movement within the valve body 1 thereby to operate in cooperation with its valve seat 9 to open and shut communication between the first and second gas passages 2 and 3; and a second needle valve 8 also operating in sliding movement in cooperation with its valve seat 10, to open and shut communication between the second gas passage 3 and the combustion chamber 6.

These parts are disposed approximately as shown in FIG. 1, the first gas passage 2 and the first needle valve 7 being disposed at upstream positions in the valve body 1, the second needle valve 8 being disposed at a downstream position near the injection end of the valve body 1.

The first needle valve 7 is provided with driving means for actuating it in both its opening and shutting directions. In the illustrated embodiment, this driving means is a hydraulic system including a first piston 11 integrally and coaxially connected to or formed with the first needle valve 7 and slidably fitted in a sliding chamber 13 constituting a first hydraulic cylinder within the valve body 1 and having first and second pressure chambers 15 and 16 respectively on the sides of the piston 11 remote from and near the first needle valve 7. The first pressure chamber 15 is supplied with hydraulic pressure through a fluid flow path 17. This hydraulic pressure forces the piston 11, and therefore the first needle valve 7; to slide toward the valve seat 9, thereby shutting the needle valve 7 and shutting communication between the first and second gas passages 2 and 3. When hydraulic pressure is supplied through a hydraulic fluid passage 18 to the second pressure chamber 16, the piston 11 is forced to slide away from the valve seat 9 thereby to open the first needle valve 7.

Similarly, the second needle valve 8 is integrally and coaxially connected to or formed with a second piston 12 slidably fitted in a sliding chamber or second hydraulic cylinder 14. A part of this cylinder on the side of the piston 12 nearer to the valve seat 10 constitutes a third pressure chamber 20, which communicates with the above mentioned hydraulic fluid passage 18. A compression spring 19 is interposed under compression between the other side of the second piston 12 and the end wall of the cylinder 14 and thereby exerts a force on the piston 12 urging it to slide toward the valve seat 10 thereby to shut the second needle valve 8. When hydraulic pressure is supplied via the fluid passage 18 into the third pressure chamber 20, it forces the piston 12, together with the second needle valve 8, to slide away from the valve seat 10 thereby to open the second needle valve 8. A hydraulic fluid return line 21 including passages in the valve body 1 is provided for returning hydraulic fluid from the second and third pressure chambers 16 and 20 and is provided with a relief valve 22.

It is to be noted that, when the first needle valve 7 is in its closed state, the extreme tip part of this valve 7 is exposed to and residing within the interior of the second injection gas passage 3. Therefore, the first needle valve 7 is urged toward its opening direction by a force F3 exerted by the gas within this second gas passage 3. Accordingly, during normal operation, the first needle valve 7 is being forced toward its opening direction by the sum (F2+F3) of the above mentioned force F3 due to the gas within the second gas passage 3 and the force F2 exerted on the first piston 11 in the second pressure chamber 16 of the hydraulic system.

In the case where sticking occurs in the second needle valve 8, which therefore cannot be closed, the second gas passage 3 then becomes continually communicative with the combustion chamber 6, and consequently the gas pressure within the second gas passage 3 drops considerably. As a result, of the force (F2+F3) acting to move the first needle valve 7 toward its opening direction, the force F3 due to the gas within the gas passage 3 is decreased considerably. For this reason, the force F2 due to the hydraulic system in its normal state becomes insufficient to keep the first needle valve 7 open, whereby the supply of fuel gas to the combustion chamber is shut off.

The operation of this gas injection valve will now be described more fully.

When the gas injection valve is in its normal state, the forces acting on the first needle valve 7 are a force F1 toward the valve seat 9 exerted by the hydraulic fluid within the first pressure chamber 15, the aforedescribed force F2 directed away from the valve seat 9 due to the pressure of the hydraulic fluid within the second pressure chamber 16, and the aforedescribed force F3 also directed away from the valve seat 9 and exerted on the extreme tip of the first needle valve 7 by the injection gas within the second gas passage 3.

In the case where the hydraulic pressure is low, the relationship between these opposing forces is $$F1 > (F2+F3),$$

whereby the first needle valve 7 is being forced toward its valve seat 9 and is thus in its closed state.

At the same time, the forces acting on the second needle valve 8 are a force F4 directed toward the valve seat 10 and exerted by the spring 19, a force F5 directed away from the valve seat 10 due to the hydraulic pressure within the third pressure chamber 20, and a force F6 also directed away from the valve seat 10 and exerted on the extreme tip of the second needle valve 8 by the gas within the nozzle chamber 4. Then, under the same condition of low hydraulic pressure, $$F4 > (F5+F6),$$

whereby the second needle valve 8 is also being forced toward its valve seat 10 and is therefore in its closed state.

Figure 2:
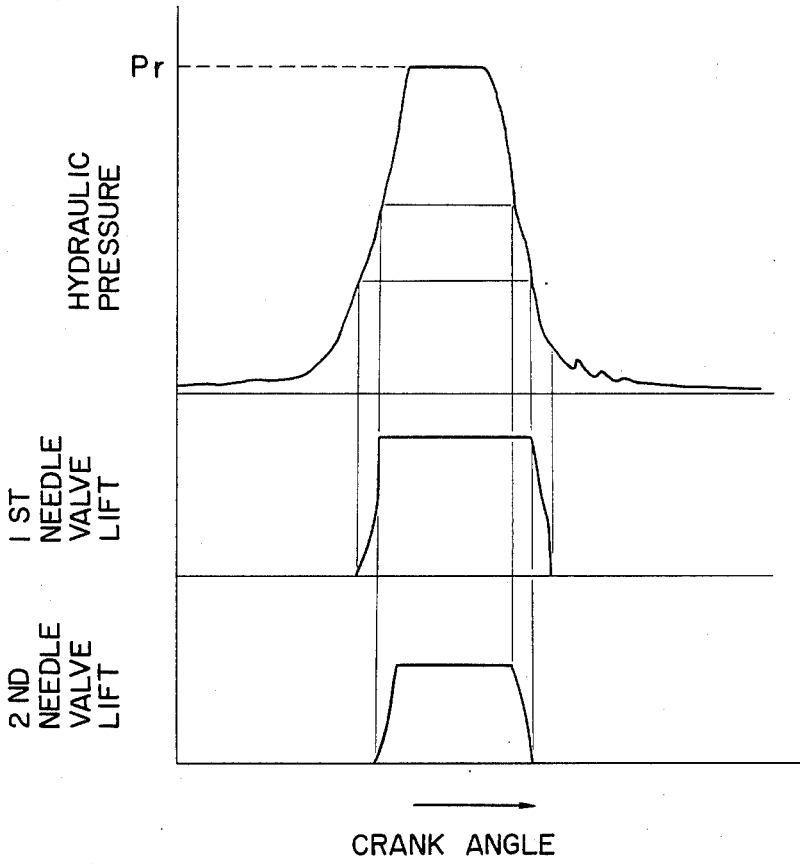
FIG. 2, is a graph indicating the relationships between respective movements of first and second needle valves and hydraulic pressure for actuating these needle valves in opening and closing movements in the gas injection valve of the invention with variation of the crank angle of the engine.

Then, as the hydraulic pressure within the hydraulic fluid passage 18 begins to rise, first, the force F2 due to the hydraulic pressure within the second pressure chamber 16 at the first needle valve 7 increases as indicated in FIG. 2, and the relationship between the opposing forces F1, F2 and F3 becomes $$F1<(F2+F3),$$

whereby the first needle valve 7 rapidly assumes its opened state. On the other hand, at the second needle valve 8, the relationship of the opposing forces remains as $$F4>(F5+F6),$$

whereby the second needle valve 8 still remains in its closed state.

Then, as the hydraulic pressure rises further, as indicated in FIG. 2, the force relationship at the second needle valve 8 also becomes $$F4<(F5+F6),$$

whereby the second needle valve 8 rapidly opens. Accordingly, the injection gas passes through the first gas passage 2, the second gas passage 3, and the nozzle chamber 4 and, being ejected through the nozzle holes 5, is injected into combustion chamber 6.

Furthermore, the hydraulic pressure thereafter rises further until it reaches the preset relief pressure of the relief valve 22, which thereupon opens, and hydraulic fluid is released through the return line, and the hydraulic pressure ceases to rise above the relief pressure.

Then, as the hydraulic pressure decreases after the injection valve has assumed the above described state, the above described operation is reversed. That is, first, the second needle valve 8 assumes its closed state, and then, as the hydraulic pressure decreases further, the first needle valve 7 becomes closed.

By the repetition of the above described operation, the fuel gas is periodically injected into the combustion chamber 6. A particularly noteworthy point in this operation is that, when the first needle valve 7 is in its closed state, the pressure within the second injection gas passage 3 is maintained at substantially the same pressure as that of the injection gas. That is, since the second needle valve 8 is opened after the first needle valve 7 and, further, is closed before the first needle valve, high-pressure injection gas is supplied to and charged into the second injection gas passage 3 during the period from the opening of the first needle valve 7 to the opening of the second needle valve 8 and during the period from the closure of the second needle valve 8 to the closure of the first needle valve 7.

Next, the operation of this gas injection valve in the case where sticking of the second needle valve 8 has occurred, and valve 8 cannot be closed, will be considered. The fuel gas is normally injected into the combustion chamber 6 until the first needle valve 7 is caused to close by a decrease in the hydraulic pressure. In the case wherein the second needle valve cannot be closed, however, the fuel gas within the second injection gas passage 3 continues to be injected into the combustion chamber 6 even after the first needle valve 7 is closed as mentioned above. Then, when from this operational state, the operation reaches the succeeding injection timing instant, the second gas passage 3 is communicating with the combustion chamber 6 since the second needle valve 8 is still in its open state, and the pressure within the gas passage 3 is substantially equal to that within the combustion chamber 6.

In general, the pressure within the combustion chamber 6 is considerably lower than that of the injection gas. For this reason, at the first needle valve 7, the force F3 acting on the tip of the needle valve 7 in the direction away from the valve seat 9 as a result of the pressure of the gas within the second gas passage 3 is in a greatly reduced state. Accordingly, in order to fulfil the condition for opening the first needle valve 7, that is, the condition $$F1<(F2+F3),$$

it is necessary to greatly increase the force F2, directed away from the valve seat 9 due to the hydraulic pressure within the second pressure chamber 16, above its normal-state value. That is, in order to open the first needle valve 7 with the second needle valve 8 in a state of being stuck and being unclosable, the hydraulic pressure must be elevated to a pressure which is much higher than that required to open the valve 7 under normal circumstances.

On the other hand, since the maximum hydraulic pressure is limited by the relief valve 22 as described hereinbefore, by setting the relief pressure of the relief valve 22 lower than the pressure necessary for opening of the first needle valve 7 with the second needle valve 8 in the stuck state, opening of the first needle valve can be prevented. That is, in the case of sticking of the second needle valve 8, the first needle valve 7 is maintained in its closed state, and further injection of fuel gas into the combustion chamber 6 is prevented.

At the start of operation of the above described gas injection valve, the gas pressure within the second gas passage 3 is in a reduced state, whereby the force F3 directed away from the valve seat 9 and acting on the first needle valve 7 is reduced. At the time of starting, however, by reducing the hydraulic pressure introduced into the first pressure chamber 15, an operation which is substantially the same as that in the normal state becomes possible. Furthermore, in the case where, after starting of operation, the gas pressure within the second gas passage 3 has assumed an increased state, the above described operation is carried out by increasing the above mentioned hydraulic pressure.

Figure 3:
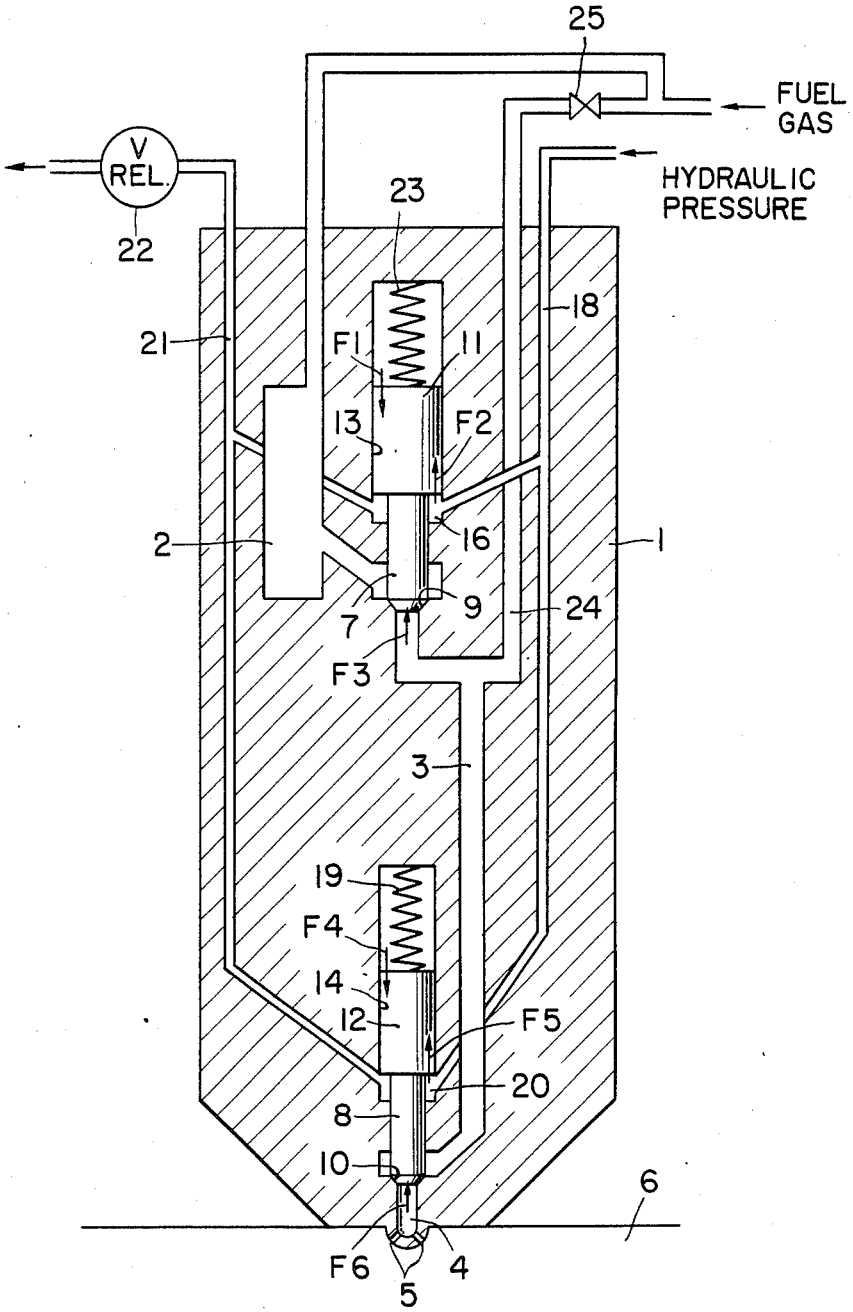
FIG. 3 is a view similar to FIG. 1 showing a second form of the gas injection valve of the invention.

A second form of the gas injection valve of this invention will now be described with reference to FIG. 3. In FIG. 3 those parts and forces which are the same as or equivalent to corresponding parts and forces in FIG. 1 are designated by like reference numerals and characters. Detailed description of such parts and forces will not be repeated. This second form of the gas injection valve differs from the preceding first form in that: (1) a compression spring 23 is used as means for urging the first needle valve 7 towards its valve seat 9, i.e., its closing position; (2) an additional separate injection gas passage 24 is formed in the valve body 1 and is communicatively connected to the second injection gas passage 3; and (3) a valve 25 is provided at a point in the gas line supplying fuel gas to the gas passage 24 and is operable to control the supplying and shutting off of fuel gas to the gas passage 24. In other respects, the construction of this gas injection valve is the same as that of the preceding embodiment.

By the provision of a separate injection gas passage 24 in this manner, fuel gas is introduced into the second gas passage 3 by opening the valve 25 thereby to bring the gas pressure within this gas passage 3 to approximately the gas pressure at the time of normal operation, whereby the operation starting characteristic is improved. Then, after beginning of the operation, in which the gas pressure within the second gas passage 3 has reached its specified value, the valve 25 is closed thereby to shut off the supply of fuel gas through this valve and the gas passage 24.

Figure 4:
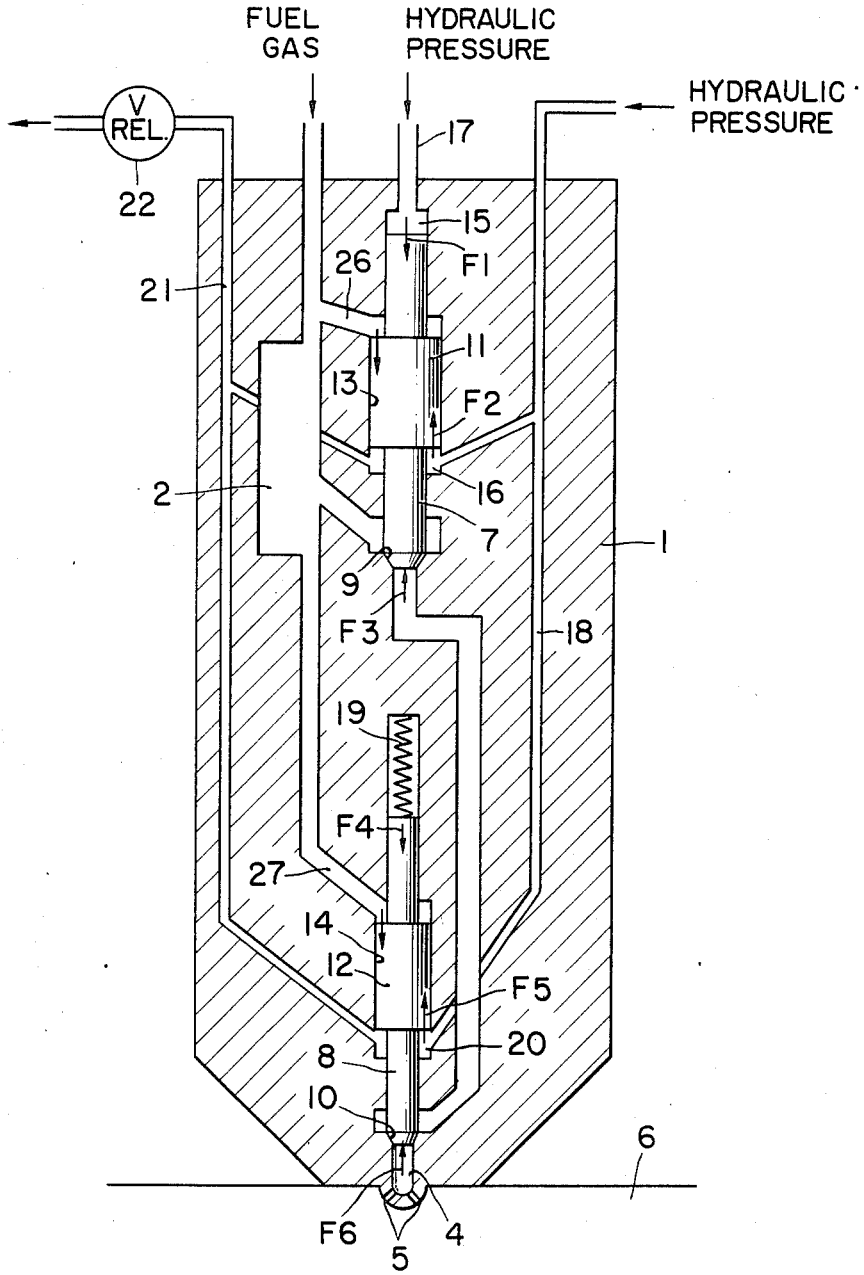
FIG. 4 is a view also similar to FIG. 1 showing a third form of the gas injection valve of the invention.

A third form of the gas injection valve of this invention will now be described with reference to FIG. 4. This injection valve differs from that of the aforedescribed first form in that flow paths 26 and 27 are provided to introduce fuel gas to the ends of the pistons 11 and 12 of the first and second needle valves 7 and 8 respectively remote from their valve seats 9 and 10, whereby the pressure of the fuel gas is utilized addition to the hydraulic pressure in the first pressure chamber 15 and the force of the spring 19 thereby to augment the forces F1 and F4 acting on the first and second needle valves 7 and 8 in the direction toward their valve seats 9 and 10. The other parts of this embodiment are respectively the same as corresponding parts in the embodiment illustrated in FIG. 1.

By this construction of the gas injection valve, gas pressure is caused to act on the needle valves 7 and 8 in both opening and closing directions thereof, whereby the balance between the forces in these two directions becomes good, and, moreover, impact forces acting on the valve seats 9 and 10 are lessened. Furthermore, even in the case where the spring 19 for urging the second needle valve 8 toward its valve seat 10 has been broken, this needle valve 8 is closed by gas pressure, whereby the safety of the gas injection valve is improved.

In each of the above described embodiments of this invention, a relief valve 22 is installed in the return line 21 for the hydraulic fluid to set the maximum hydraulic pressure in the pressure chambers 16 and 20 of the first and second needle valves 7 and 8. In the case where, with the gas injection valve in a state wherein sticking has occurred in the second needle valve 8, the hydraulic pressure required for opening the first needle valve becomes higher than the maximum available pressure of the hydraulic fluid, it is possible to omit the installation of the relief valve 22.

In the gas injection valve of the above described construction according to this invention, the extreme tip of the first needle valve is disposed within the second injection gas passage, and the first needle valve is actuated in its opening direction by the combination of a force due to the gas pressure within the second injection gas passage and a force due to the hydraulic system. Therefore, in the case where sticking occurs in the second needle valve, which thereby cannot be closed, the second gas passage becomes communicative with the combustion chamber, whereby the gas pressure within the gas passage is considerably lowered. For this reason, the force urging the first needle valve in the opening direction also is reduced, and as a consequence, the first needle valve does not open and is kept in a closed state. Thus, when sticking occurs in the second needle valve, the supply of fuel gas is shut off by the first needle valve. For this reason, it becomes possible to prevent defective and undesirable occurrences arising heretofore, such as continuous discharge of injection gas into the combustion chamber to cause abnormal combustion or flowing of continuously ejected fuel gas in an uncombusted state into the engine exhaust pipe or the air intake pipe to cause a gas explosion.

Particularly, since the second needle valve is installed in a position nearer to the combustion chamber than the first needle valve, it tends to assume a high temperature and becomes susceptible to infiltration thereinto of substances such as combustion gas and residue of combustion, whereby the possibility of sticking occurring therein is high. However, because this second needle valve is provided with a safety mechanism as described above, the safety factor of the gas injection valve as a whole is greatly improved.

Furthermore, in the case of sticking of the first needle valve in its closed state, the fuel gas is not injected into the combustion chamber. On the other, even when sticking occurs in the first needle valve in its opened state, since the second needle valve has the same function as a conventional valve, even when sticking in the first needle valve is considered, the safety factor of this gas injection valve as a whole will be comparable to that of a known gas injection valve.

What is claimed is:

1. A gas injection valve for injecting gas into a combustion chamber of a gas engine, said injection valve comprising:

an injection valve body having a nozzle chamber with nozzle holes for thus injecting fuel gas into a combustion chamber, means forming a first gas passage for introducing fuel gas into said body, and means forming a second gas passage having an upstream end communicable with said first gas passage and a downstream end communicable with said nozzle chamber;

a first needle valve disposed between said first and second gas passages for closing and opening communication therebetween;

a second needle valve disposed between said second gas passage and said nozzle chamber for closing and opening communication therebetween;

actuating means for applying forces respectively for urging said first and second needle valves in the closing direction thereof;

hydraulic actuating means for applying forces respectively urging said needle valves in the opening directions thereof; and means for, upon said second needle valve being prevented from closing, whereby said second gas passage is exposed to the reduced pressure of the combustion chamber, automatically moving said first needle valve to the closed position thereof and thereby preventing further supply of fuel gas to said nozzle holes, said automatic moving means comprising said first needle valve having at an extreme tip end thereof a pressure receiving face which is disposed within said second gas passage and exposed to the pressure therein in the closed position of said first needle valve, and said force applied by said actuating means to move said first needle valve in said closing direction thereof being greater than the sum of said reduced pressure in said second gas passage and said force of said hydraulic actuating means to move of said first needle valve in said opening direction thereof.

2. A gas injection valve as claimed in claim 1, wherein said actuating means for closing said first needle valve comprises a hydraulic piston mechanism, and said actuating means for closing said second needle valve comprises a spring.

3. A gas injection valve is claimed in claim 2, further comprising gas-actuated piston means responsive to the pressure of the fuel gas in said first gas passage for imparting forces to said first and second needle valve urging the same in said closing directions thereof.

4. A gas injection valve as claimed in claim 1, wherein said actuating means for closing said first and second needle valves comprise respective springs.

5. A gas injection as claimed in claim 1, wherein said first gas passage and said second gas passage are connected with each other through a passage which is in parallel relation with said first needle valve and which is provided with a valve.

6. A gas injection valve as claimed in claim 1, wherein said hydraulic actuating means for opening said first and second needle valves includes returning hydraulic fluid passage means having a relief valve therein.

7. A gas injection valve as claimed in claim 1, wherein said actuating means for closing said needle valves and said hydraulic actuating means for opening said needle valves are operatively constructed such that, with rising pressure of the hydraulic fluid within the hydraulic actuating means in conformance with the cyclic operation of the engine, said first needle valve is first opened and then said second needle valve is opened, and with subsequent decreasing hydraulic pressure, said second needle valve is first closed and then said first needle valve is closed.

* * * * *